US006121870A

United States Patent [19]

Ariga et al.

[11] Patent Number: 6,121,870

[45] Date of Patent: Sep. 19, 2000

[54] PRESSURE SENSITIVE TRANSDUCER WITH PRESSURE SENSITIVE LAYER INCLUDING SEMI-CONDUCTIVE PARTICLES

[75] Inventors: Katsuhiko Ariga, Obu; Masayasu Teraoka, Chiryu; Yoshimitsu Motoki; Ichiro Ishiyama, both of Kami-Niikawagun, all of Japan

[73] Assignees: Denso Corporation; Hokuriku Electric Industry Co., Ltd., both of Niikawagun, Japan

[21] Appl. No.: 09/343,048

[22] Filed: Jun. 29, 1999

[30] Foreign Application Priority Data

Jul. 28, 1998 [JP] Japan ..... 10-213148
Apr. 8, 1999 [JP] Japan ..... 11-101701

[51] Int. Cl.[7] ..... H01C 10/10

[52] U.S. Cl. ..... 338/114; 338/47; 338/99; 338/101; 338/5

[58] Field of Search ..... 338/2, 5, 13, 47, 338/99, 101, 114, 104, 115

[56] References Cited

U.S. PATENT DOCUMENTS 2,951,817 9/1960 Myers ..... 338/99
3,806,471 4/1974 Mitchell ..... 338/114
4,163,204 7/1979 Sado et al. ..... 338/114
4,276,538 6/1981 Eventoff et al. .
4,295,699 10/1981 DuRocher ..... 338/114
4,745,301 5/1988 Michalchik ..... 338/99
4,845,457 7/1989 Nakanishi ..... 338/114
4,876,419 10/1989 Lodini ..... 338/99
5,656,988 8/1997 Podoloff ..... 338/99
5,886,615 3/1999 Burgess ..... 338/99

*Primary Examiner*—Karl D. Easthom
*Attorney, Agent, or Firm*—Pillsbury Madison & Sutro Intellectual Property Group

[57] ABSTRACT

Pressure sensitive layers are disposed on respective resin films through electrodes to face each other, and include high conductivity flaky carbon particles and low conductivity amorphous-based carbon particles. The two kinds of carbon particles are bound together by a resin-system binder. Accordingly, when a pushing force is applied to the resin films, an average distance between the carbon particles is decreased to cause a tunnel conduction phenomenon, resulting in a decrease in conductive resistance between the electrodes. As a result, a pressure sensing property can be made gentle.

5 Claims, 4 Drawing Sheets

PRESSURE SENSITIVE TRANSDUCER WITH PRESSURE SENSITIVE LAYER INCLUDING SEMI-CONDUCTIVE PARTICLES

CROSS REFERENCE TO RELATED APPLICATIONS

This application is based upon and claims the benefit of Japanese Patent Applications No. 10-213148 filed on Jul. 28, 1998, and No. 11-101701 filed on Apr. 8, 1999, the contents of which are incorporated herein by reference.

BACKGROUND OF THE INVENTION

1. Field of the Invention

This invention relates to a pressure sensitive transducer having a pair of support members with conductive layers on surfaces thereof and a pressure sensitive layer interposed therebetween.

2. Description of the Related Art

JP-B2-2-49029 discloses one kind of such apparatus, which has a pair of support members holding conductive layers (electrodes) on their surfaces and a pressure sensitive layer interposed therebetween. The pressure sensitive layer includes plural particles made of, for instance, molybdenum sulfide for providing plural contact points on the surface thereof. Accordingly, when pressure is applied to the support members, the particles exposed on the surface of the pressure sensitive layer contact the opposing conductive layer to detect the pressure.

However, the contact between the particles and the opposing conductive layer suddenly decreases the conductive resistance. Therefore, the pressure sensitive transducer described above cannot be used when a gentle pressure sensitive property is required. Further, the conductive resistance, which is decreased by the direct contact caused by applied pushing force, becomes constant regardless of voltage applied across the electrodes. This lowers flexibility for setting the pressure sensitive property.

SUMMARY OF THE INVENTION

The present invention has been made in view of the above problems. An object of the present invention is to provide a pressure sensitive transducer having a novel pressure sensitive property. Another object of the present invention is to make the pressure sensitive property gentle. Another object of the present invention is to provide a pressure sensitive transducer having a pressure sensitive property which depends on a voltage applied thereto.

According to the present invention, a pressure sensitive layer is provided between first and second conductive layers. The pressure sensitive layer comprises an insulation material layer in which plural semi-conductive particles are dispersed. When a pushing force is applied to at least one of first and second support members holding the first and second conductive layers thereon, a current flows between the first and second conductive layers. In this case, the pressure sensitive layer can be formed so that the current flowing between the first and second conductive layers has a first current produced by direct contact of the semi-conductive particles and a second current produced by a tunnel conduction phenomenon occurring among the semi-conductive particles, and so that a magnitude of the second current is larger than that of the first current. Accordingly, the value of conductive resistance between the first and second conductive layers is decreased approximately in proportion to the pushing force, thereby making the pressure sensitive property gentle.

The pressure sensitive layer can be formed so that an average distance between the plural semi-conductive particles is decreased to be equal to or less than 100 nm when the pushing force is applied to at least one of the first and second support members. In this case, likewise, the pressure sensitive property becomes gentle.

Also, the pressure sensitive layer can be formed so that when the pushing force is applied to at least one of the first and second support members to cause a current to flow between the first and second conductive layers across which a voltage is applied, a value of conductive resistance between the first and second conductive layers is decreased as the voltage is increased. Accordingly, the pressure sensitive property can be easily controlled by the voltage applied across the first and second conductive layers.

BRIEF DESCRIPTION OF THE DRAWINGS

Other objects and features of the present invention will become more readily apparent from a better understanding of the preferred embodiments described below with reference to the following drawings.

DETAILED DESCRIPTION OF THE PREFERRED EMBODIMENTS

Figure 1:
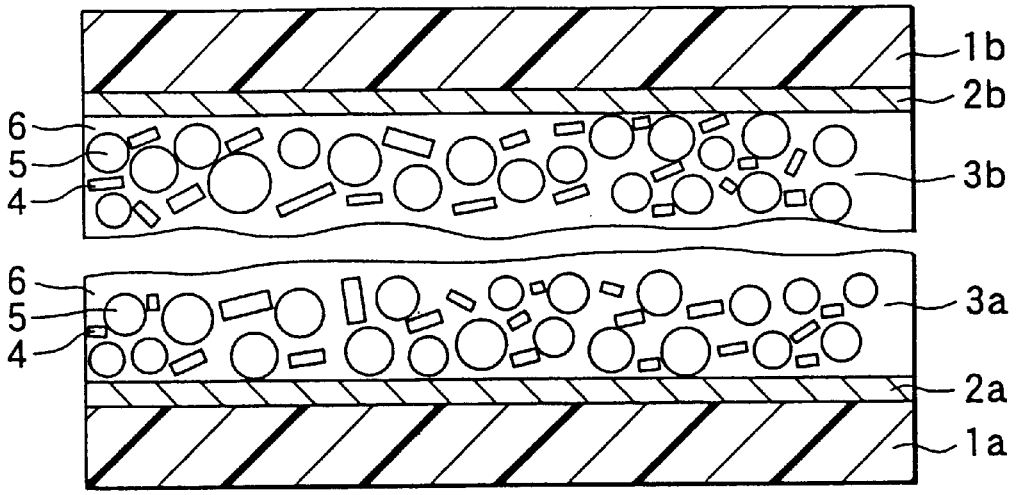
FIG. 1 is a cross-sectional view showing a pressure sensitive transducer in a preferred embodiment according to the present invention.

A pressure sensitive transducer shown in FIG. 1 in a preferred embodiment of the present invention is used as a passenger sensor for an automotive air bag apparatus, capable of changing an expanding speed of an air bag according to a weight of a passenger, a sensor for detecting distribution of a weight of a person confined to a care bed, and the like.

In FIG. 1, an electrode 2*a* is disposed on a resin film (base substrate) 1*a* with a specific pattern, and a first pressure sensitive layer 3*a* is disposed on the electrode 2*a*. An electrode 2*b* having a pattern substantially identical with that of the electrode 2*a* is disposed on a resin film 1*b*, and a second pressure sensitive layer 3*b* is disposed on the electrode 2*b* to face the first pressure sensitive layer 3*a*.

The pressure sensitive layers 3*a*, 3*b* contain flaky carbon (graphite) particles 4 having high conductivity and a small average size (average particle diameter), and amorphous based spherical carbon particles 5 having low conductivity and a large average size. The particles 4, 5 are bound together by an elastic resin based binder 6 (for instance, made of polyester system resin having a high glass phase transition temperature). That is, the two kinds of carbon particles 4, 5 are distributed in the insulation material layer 6. Since the pressure sensitive layers 3*a*, 3*b* include the two kinds of carbon particles 4, 5 having different shapes and sizes from each other on average, the density of the carbon particles 4, 5 is increased, and an average distance between an adjacent pair of carbon particles is decreased. Accordingly, when pressure is applied to at least one of the resin films 1*a*, 1*b*, the average distance can be decreased to be equal to or less than 100 nm to cause a tunnel conduction phenomenon.

Incidentally, a gap (air layer) is provided between the pressure sensitive layers 3*a*, 3*b* by a spacer which is not shown in FIG. 1. Because the surfaces of the pressure sensitive layers 3*a*, 3*b* are almost covered with the resin system binder 6, the pressure sensitive layers 3*a*, 3*b* are allowed to partially contact with each other.

Figure 2:
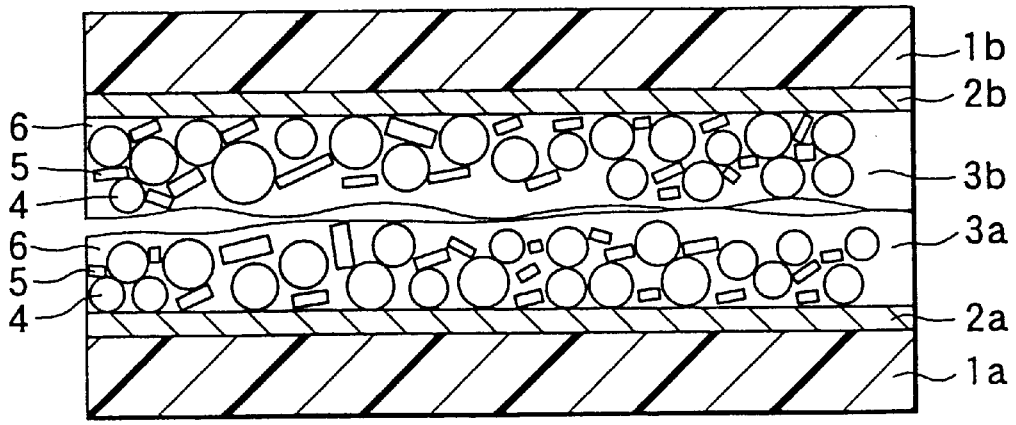
FIG. 2 is a cross-sectional view showing a state where a pushing force is applied to the pressure sensitive trasducer shown in FIG. 1.

FIG. 2 shows a state of the pressure sensitive films 3*a*, 3*b* when pressure, i.e., pushing force is applied to at least one of the resin films 1*a*, 1*b*. In this state, as shown in the figure, the surfaces of the pressure sensitive layers 3*a*, 3*b* contact with each other at plural portions. Further, the average distance between the adjacent carbon particles in the pressure sensitive layers 3*a*, 3*b* is decreased to be equal to or less than 100 nm. Therefore, the application of a voltage causes the tunnel conduction phenomenon to decrease the value of conductive resistance between the electrodes 2*a*, 2*b*.

Figure 3:
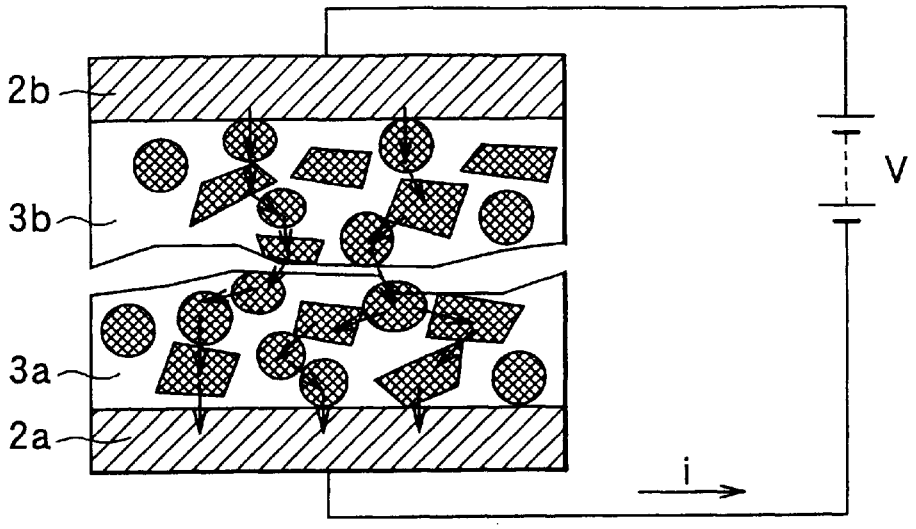
FIG. 3 is a view showing a state where tunnel current flows.

That is, when the average distance between the carbon particles is equal to or less than 100 nm, a potential barrier between the carbon particles is decreased to increase tunnel conductive electrons, resulting in a decrease in the value of conductive resistance between the electrodes 2*a*, 2*b*. As a result, as shown in FIG. 3, tunnel current i represented by the following formula (1) flows between the electrodes 2*a*, 2*b*.

$$i \exp\{-e(\varnothing - V)/kT\} \quad \ldots (1)$$

wherein ø is the potential barrier depending on the distance between the carbon particles, V is the applied voltage, k is Boltzmann's constant, and T is the temperature in degrees Kelvin.

Figure 4:
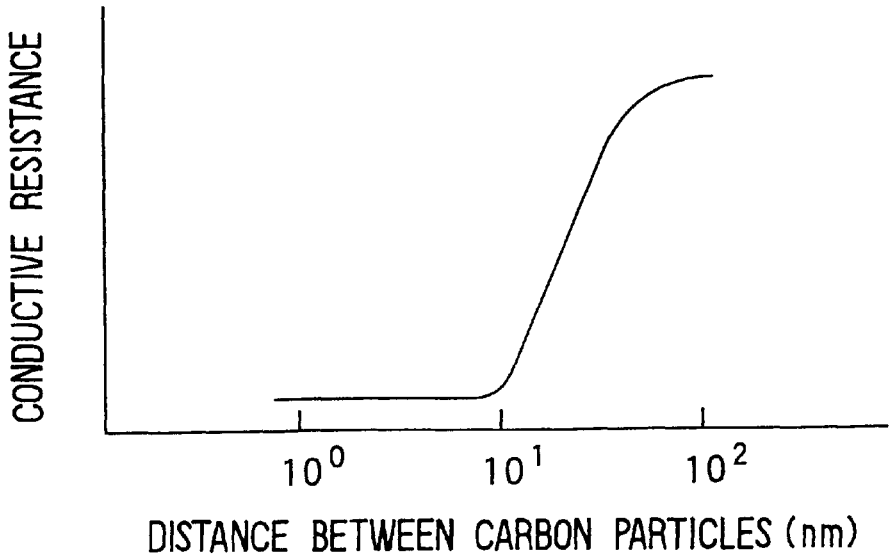
FIG. 4 is a graph showing a relationship between a distance between carbon particles and a value of conductive resistance.

As understood from the formula (1), the tunnel current, which flows due to the tunnel conduction phenomenon, increases in inverse proportion to the distance between the carbon particles (not as primary proportion). As a result, as shown in FIG. 4, the value of conductive resistance gradually deceases as the distance between the carbon particles decreases from 100 nm. That is, the value of conductive resistance deceases approximately in proportion to the magnitude of the pushing force applied thereto. The magnitude of the pushing force can be detected by measuring the value of conductive resistance. Thus, the pressure sensitive property can be mitigated by utilizing the tunnel conduction phenomenon when the pushing force is detected.

Incidentally, when applying the pushing force, there is not only the current caused by the tunnel conduction phenomenon, but there is also current caused by direct contact between the carbon particles flow between the electrodes 2*a*, 2*b*. However, the main current flowing between the electrodes 2*a*, 2*b* is the current produced by the tunnel conduction phenomenon and having a magnitude much larger than that of the current produced by the direct contact.

In the pressure sensitive layers 3*a*, 3*b* described above, because two kinds of carbon particles 4, 5, with average sizes different from one another, are included therein, the carbon densities in the pressure sensitive layers 3*a*, 3*b* can be increased. When a ratio between the average sizes is small, the conductivity becomes too small to cause the tunnel conduction phenomenon. It is preferable for causing the tunnel conduction phenomenon that the ratio between the average sizes of the carbon particles 4, 5 is equal to or larger than 2.

The pressure sensitive layers 3*a*, 3*b* described above are formed by printing, spraying, or the like. When the average size of the carbon particles is larger than 10 μm, the pressure sensitive layers 3*a*, 3*b* have plural carbon particles protruding from the surfaces thereof. The protruding carbon particles are easily brought to be in direct contact with each other when the pushing force is applied thereto, and accordingly, the value of conductive resistance suddenly deceases.

On the other hand, when the average size of the carbon particles is less than 0.5 μm, the minute particles gather to form secondary chains, which also suddenly decrease the value of conductive resistance when the pushing force is applied. Therefore, the average size of the carbon particles is preferably in a range of 0.5 μm to 10 μm inclusive to control the value of conductive resistance relative to the pushing force in a stable manner, utilizing the tunnel conduction phenomenon.

Also, because the conductivities of the two kinds of the carbon particles 4, 5 contained in the pressure sensitivity layers 3*a*, 3*b* are different from each other, the value of conductive resistance relative to the pushing force can be controlled in a stable manner by adjusting the mixing ratio between the carbon particles 4, 5.

When the total mixing ratio of the carbon particles 4, 5 in the pressure sensitive layers 3*a*, 3*b* is too small, the carbon densities in the pressure sensitivity layers 3*a*, 3*b* are decreased so that it becomes difficult to cause the tunnel conduction phenomenon. On the other hand, when the total mixing ratio is too large, the carbon particles are easily brought to be in direct contact with one another to reduce the rate of causing the tunnel conduction phenomenon. Therefore, the preferable total mixing ratio of the carbon particles 4, 5 is in a range of 10 wt. % to 50 wt. % inclusive.

Figure 5:
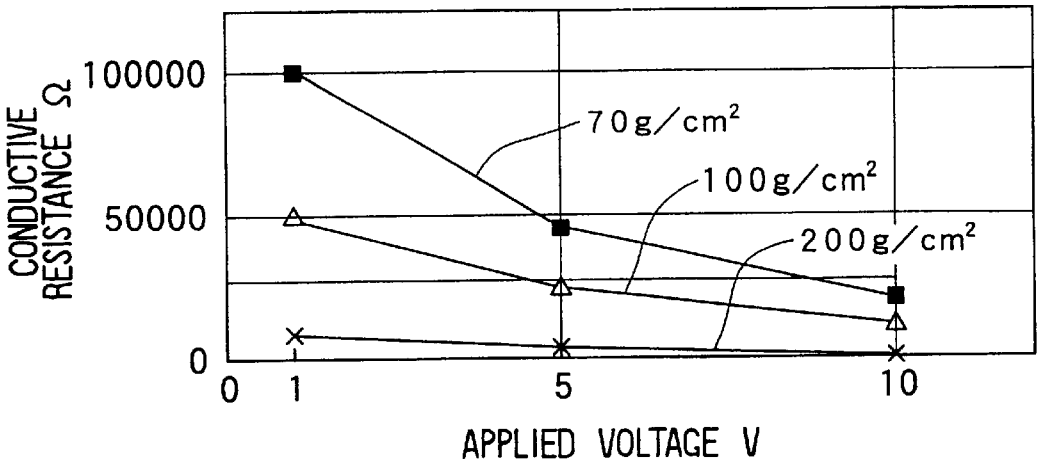
FIG. 5 is a graph showing changes of the value of conductive resistance Ω relative to applied voltage V.

Further, as understood from the formula (1) described above, the potential barrier is lowered by the schottky effect as the applied voltage v becomes large. Therefore, the value of conductive resistance Ω relative to the applied voltage V varies. FIG. 5 shows changes in the value of conductive resistance Ω relative to the applied voltage v when pushing forces of 70 g/cm$^2$, 100 g/cm$^2$, 200 g/cm$^2$ are respectively applied. In this test, each of the pressure sensitive layers 3*a*, 3*b* included the flaky carbon particles 4 having 1 μm in average size and the amorphous based carbon particles 5 having 5 μm in average size. The mixing ratio between the carbon particles 4, 5 was 1:1, and the total mixing ratio of the carbon particles 4, 5 was approximately 40 wt. % in each of the pressure sensitive layers 3*a*, 3*b*.

As shown in FIG. 5, the value of conductive resistance Ω decreases as the applied voltage increases. Further, the property changes based on the pushing force. This is because the tunnel current flows in the pressure sensitive layers 3*a*, 3*b* utilizing the tunnel conduction phenomenon. The change in the applied voltage varies the magnitude of the potential barrier to change the tunnel current even when the pushing force and the distance between the carbon particles are not changed. Incidentally, in a conventional one utilizing direct contact, because current flows by the direct contact (ohmic contact) when the pushing force is applied, the value of conductive resistance is constant without depending on the applied voltage. Therefore, the pressure sensitive transducer according to the present invention can provide the pressure sensitive property using the applied voltage as a parameter.

Figure 6:
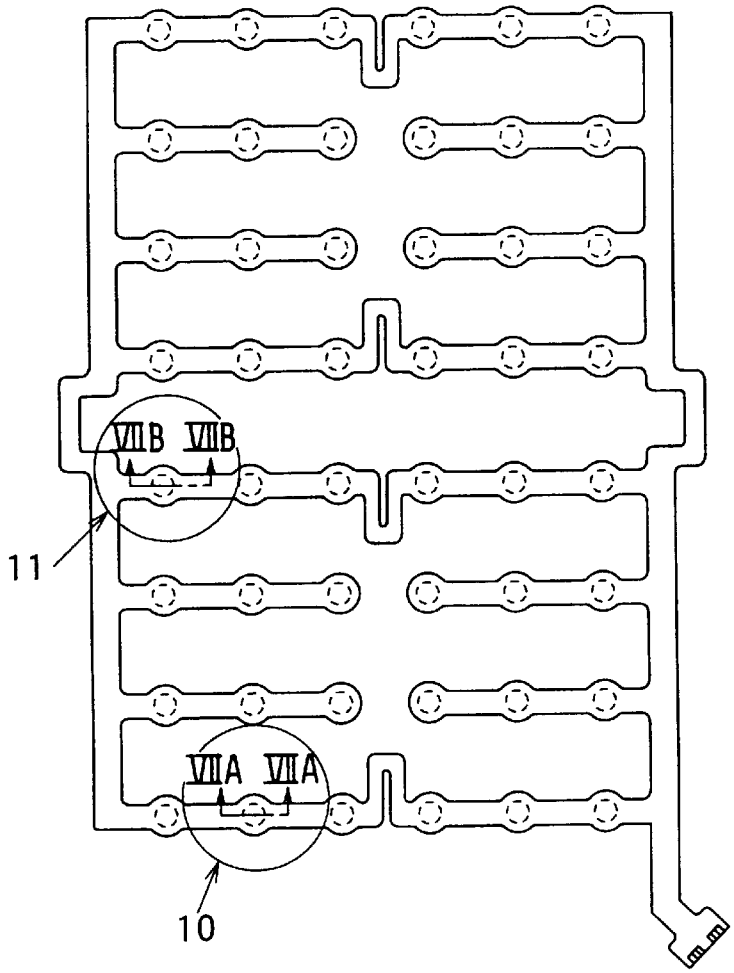
FIG. 6 is a plan view specifically showing the pressure sensitive transducer.
Figure 7A:
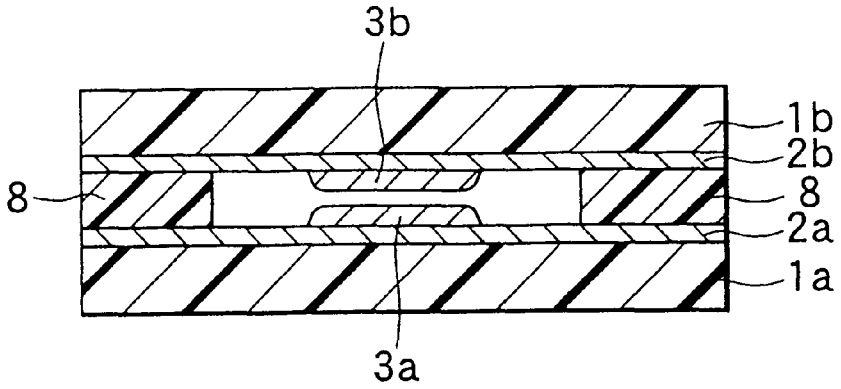
FIG. 7A is a cross-sectional view taken along a $VII_A$—$VII_A$ line in FIG. 6.
Figure 7B:
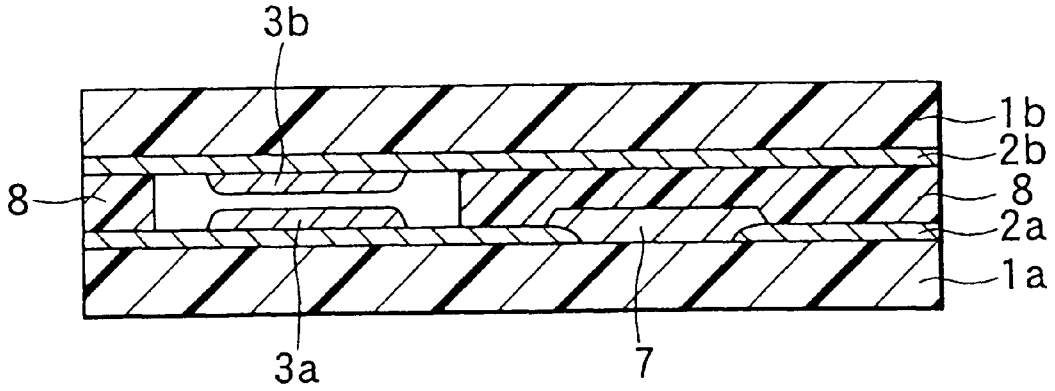
FIG. 7B is a cross-sectional view taken along a $VII_B$—$VII_B$ line in FIG. 6.

The constitution of the pressure sensitive transducer is specifically shown in FIG. 6. In FIG. 6, a pattern indicated by solid lines shows the upper electrode 2*b*, and plural circle portions indicated by dotted lines show the pressure sensitive layers 3*a*, 3*b*. In the pressure sensitive transducer shown in FIG. 6, the pressure sensitive property changes according to detection regions. Specifically, in a sensing part 11, a cross-sectional view of which is shown in FIG. 7B, a fixed resistive member 7 is inserted into the electrode 2*a* contacting the lower pressure sensitive layer 3*a* to reduce the applied voltage across the electrodes 2*a*, 2*b*. In a sensing part 10, a cross-sectional view of which is shown in FIG. 7A, the fixed resistance 7 is not inserted into the electrodes not to reduce the applied voltage across the electrodes 2*a*, 2*b*. That is, the value of resistance at the sensing part 11 is different from that at the sensing part 10, and accordingly the applied voltage changes according to the positions in the electrodes 2*a*, 2*b*. The pressure sensing property can be set according to the detection regions.

As shown in FIGS. 7A and 7B, the pressure sensitive layers 3*a*, 3*b* are opposed to each other with the air layer intervening therebetween which is defined by a spacer 8. The spacer 8 is composed of a polyester film, both surfaces of which are coated with adhesive.

According to the embodiment described above, the amorphous based carbon particles 5 are used as a first group of semi-conductive particles, and the flaky carbon (graphite) particles 4 are used as a second group of semi-conductive particles. However, the materials for the first and second groups of semi-conductive particles are not limited to the carbon particles 4, 5. For instance, a metal oxide semiconductor such as $SnO_2$ or $In_2O_3$, a metal sulfide semiconductor such as $MoS_2$, or the like may be used as either one of the first and second groups of semi-conductive particles. In such a case, the same effects described above can be provided when the average size, mixing ratio, and the like are set as described above.

Also, only carbon black of approximately 10 nm in an average particle diameter may be used as the semi-conductive particles. In the case where such minute carbon particles are used, the minute carbon particles secondarily gather as so called structure carbon particles. Therefore, when the level at which the carbon particles secondarily gather is controlled, the minute carbon particles and structure carbon particles can be desirably dispersed within the resin system binder 6. Accordingly, the average distance between the carbon particles can be controlled to be equal to or less than 100 nm so that the tunnel conduction phenomenon mainly occurs. Preferably, the average size of the structure carbon particles is in a range of 0.5 $\mu$m to 10 $\mu$m inclusive as described in the above embodiment. The mixing ratio of the carbon particles contained in the pressure sensitive layers 3*a*, 3*b* is also preferably in a range of 10 wt. % to 50 wt. % inclusive as described above.

Although the resin system binder 6 is used to form the insulation material layer in the embodiment, rubber system binder may be used instead of the resin system binder. However, it should be noted that the rubber system binder is inferior to the resin system binder in stability for a long period of time due to compressive creep.

Because the surfaces of the pressure sensitive layers 3*a*, 3*b* are covered with the resin system binder 6, the pressure sensitive layers 3*a*, 3*b* may dispense with the spacer 8 to be in contact with each other. The pressure sensitive layers 3*a*, 3*b* are respectively provided on the resin films 1*a*, 1*b*; however, only one of the pressure sensitive layers 3*a*, 3*b* may be provided on a corresponding one of the resin films 1*a*, 1*b*.

While the present invention has been shown and described with reference to the foregoing preferred embodiments, it will be apparent to those skilled in the art that changes in form and detail may be made therein without departing from the scope of the invention as defined in the appended claims.

What is claimed is:

1. A pressure sensitive transducer comprising:

first and second conductive layers facing each other; and a pressure sensitive layer provided between the first and second conductive layers, said pressure sensitive layer comprising an insulation material layer and a plurality of semi-conductive particles dispersed in said insulation material layer;

wherein, when a pushing force is applied to at least one of the first and second conductive layers, a current flows between said first and second conductive layers, said current including a first current produced by said semi-conductive particles directly contacting each other, and a second current produced by a tunnel conduction phenomenon among certain non-contacting ones of the semi-conductive particles separated by a gap equal to or less than a tunnel conduction enabling distance, the second current having a magnitude larger than a magnitude of the first current.

2. The pressure sensitive transducer of claim 1, wherein the semi-conductive particles are present in the insulation material layer in an amount ranging substantially between 10 wt. % and 50 wt. %.

3. The pressure sensitive transducer according to claim 1, wherein said specified distance is substantially 100 nm.

4. The pressure sensitive transducer according to claim 1, wherein said second current has a magnitude larger than zero when a voltage applied across the first and second conductive layers is equal to or less than 10 V.

5. The pressure sensitive transducer according to claim 1, further comprising first and second pressure sensing regions, the first and second pressure sensing regions respectively comprising the first and second conductive layers, and comprising plural pressure sensitive layers provided between the first and second conductive layers, the first pressure sensing region having a resistance larger than a resistance of the second pressure sensing region.

* * * * *